United States Patent [19]

Masuzawa et al.

[11] Patent Number: 4,716,591

[45] Date of Patent: Dec. 29, 1987

[54] SPEECH SYNTHESIS METHOD AND DEVICE

[75] Inventors: Sigeaki Masuzawa, Nara; Shinya Shibata, Yamatokoriyama; Hiroshi Miyazaki; Tetsuo Iwase, both of Nara, all of Japan

[73] Assignee: Sharp Kabushiki Kaisha, Osaka, Japan

[21] Appl. No.: 795,760

[22] Filed: Nov. 8, 1985

Related U.S. Application Data

[63] Continuation of Ser. No. 577,482, Apr. 6, 1984, abandoned, which is a continuation of Ser. No. 398,906, Jul. 16, 1982, abandoned, which is a continuation of Ser. No. 123,065, Feb. 20, 1980, abandoned.

[30] Foreign Application Priority Data

Feb. 20, 1979 [JP] Japan ..... 54-19309

[51] Int. Cl.[4] ..... G10L 5/00

[52] U.S. Cl. ..... 381/51

[58] Field of Search ..... 381/51–53; 364/513.5

[56] References Cited

U.S. PATENT DOCUMENTS

| | | | |
|---|---|---|---|
| 3,588,353 | 6/1971 | Martin | 179/1 SM |
| 3,641,496 | 2/1972 | Slavin | 179/1 SM |
| 3,704,345 | 11/1972 | Coker et al. | 179/1 SM |
| 3,982,070 | 9/1976 | Flanagan | 381/51 |
| 4,076,958 | 2/1978 | Fulghum | 381/51 |
| 4,163,120 | 7/1979 | Baumwolspiner | 179/1 SM |

*Primary Examiner*—E. S. Kemeny

*Attorney, Agent, or Firm*—Birch, Stewart, Kolasch & Birch

[57] ABSTRACT

Speech synthesis is improved by using normalized values of pitch and amplitude data to modify phoneme signals which are further processed by a quantizing noise filter which computes and interleaves the average value between adjacent samples.

2 Claims, 13 Drawing Figures

SPEECH SYNTHESIS METHOD AND DEVICE

This application is a continuation of application Ser. No. 577,482 filed on Feb. 6, 1984; which is a Cont. of Ser. No. 398,906 filed July 16, 1982; which is a Cont. of Ser. No. 123,065, filed Feb. 20, 1980, all abandoned.

FIELD OF THE INVENTION

This invention relates to a speech synthesis technique and more particularly a method and a device for synthesizing speech messages and other complicated waveforms through the use of a recent digital technique.

BACKGROUND OF THE INVENTION

As is well known in the art in speech synthesis, the only and most significant requirement of an intelligible speech synthesizer is the generation of appropriate formant frequencies or phonemes to be reproduced.

Current and recent synthesizers operate by generating the format frequencies in the following way. Depending on the phoneme of interest, either voiced or unvoiced excitation is produced by electronic means. The voiced excitation is characterized by a power spectrum having a low frequency cutoff at the pitch frequency and a power that decreases with increasing frequency above the pitch frequency. Unvoiced excitation is characterized by a broad band white noise spectrum. One or the other of these waveforms is then passed through a series of filters or other electronic circuitry that causes certain selected frequencies (the formant frequencies of interest) to be amplified. The resulting power spectrum of voiced phonemes, when played into a speaker, produces the audible representation of the phoneme of interest. Such devices are generally called vocoders, and LPC (linear prediction coding) and PARCOR (partial auto correlation) are typical techniques for those vocoders.

In such devices the formant frequency information required to generate a string of phonemes in order to produce connected speech is generally stored in a full-sized computer that also controls the volume, the duration, voiced and unvoiced distinctions, etc. Thus, while existing vocoders are able to generate very large vocabularies, they require a full sized computer and are not capable of being miniaturized.

A recent speech synthesizer relying upon a new concept has been developed without using the vocoder techniques in order to avoid the prior art problems. That is, applicants' newly developed compression technique and a well known compression technique are combined to compress information to a tangible extent with minimum degradation of the speech intelligibility.

Such well known technology development is described in Japanese Patent Pre-publications Nos. 59207/1976 and 122004 (1977) by F. S. Mozer, whereby both quantized signals and compression instruction signals are stored in a memory of a solid state speech synthesizer and selected portions of complex sound waveforms are also stored within the synthesizer. The quantized signals, selected portions and the compression instruction signals are combined for re-synthesis purposes.

SUMMARY OF THE INVENTION

The present invention avoids the use of the conventional vocoder technique and reduces the capacity of a memory to a minimum through a unique and efficient combination of a recently developed compression technique and a time-honored compression technique, which combination compresses information to such an extent that it can be stored on a single large scale integrated circuit chip without deteriorating the intelligibility and the nature of original information.

According to the present invention, phonemes or a string of phonemes are fetched sequentially or selectively from the memory and a replacement such as the varying of pitch intervals, and varying of amplitudes and the modifying of time axis is carried out with respect to basic sound waveforms consisting of the fetched phonemes, thereby forming expanded synthesized waveforms of the digital shape.

The speech synthesizer embodying the present invention is of course applicable within a very wide range. For instance, such a device can serve in an electronic calculator as a means for providing audible results to the operator without requiring that he shift his eyes from his work. Or it can be used to provide numbers in other situations where it is difficult to read a meter. For example, upon demand it could tell a driver the speed of his car, it could tell an electronic technician the voltage at some point in his circuit, it could tell a precision machine operator the information he needs to continue his work, etc. It can also be used in place of a visual readout for an electronic timepiece. Or it could be used to give verbal messages under certain conditions. For example, it could tell an automobile driver that his emergency brake is on, or that his seatbelt should be fastened etc. Or it could be used for communication between a computer and man, or as an interface between the operator and any mechanism such as a push-button telephone, elevator, dishwasher, etc.

It is therefore an object of the present invention to provide a method for synthesizing speech from which a compact speech synthesizer can be fabricated.

It is another object of the present invention to provide a method for synthesizing speech from which a compact speech synthesizer can be fabricated by a substantial reduction in the capacity of a memory.

It is still another object of the invention to provide a method for synthesizing speech using basically digital rather than analog techniques.

The foregoing and other objectives, features and advantages of the invention will be more readily understood upon consideration of the following detailed description of certain preferred embodiments of the invention, taken in conjunction with the accompanying drawings.

DETAILED DESCRIPTION OF PREFERRED EMBODIMENTS OF THE INVENTION

Figure 1:
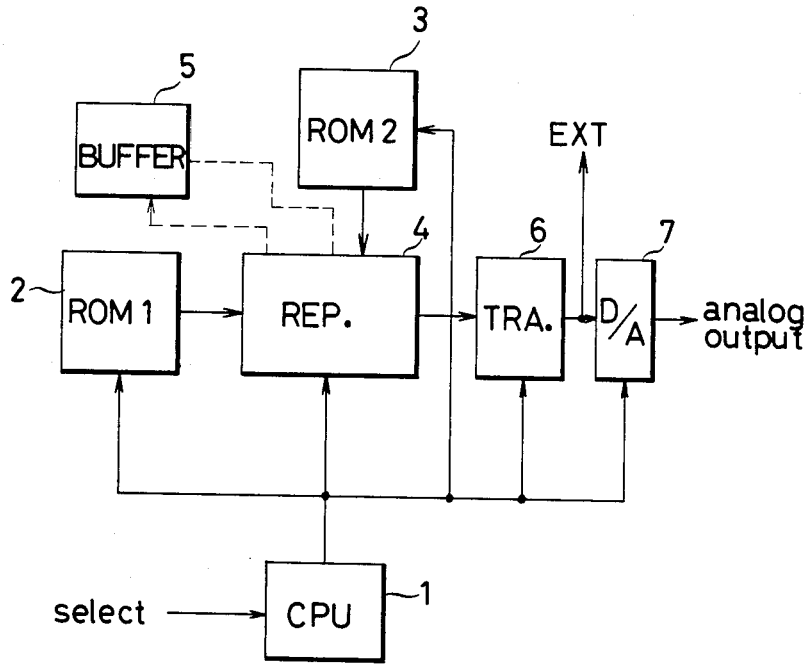
FIG. 1 is a simplified block diagram of a speech synthesizer embodying the present invention.

Referring now to FIG. 1, there is illustrated a simplified system block diagram showing a speech synthesizer constructed in accordance with the present invention, which may be split into seven blocks. In other words, the first block 1 comprises a central processor unit CPU which provides sequential control for the overall system according to selection instructions. The second block 2 includes a solid state read only memory ROM 1 for storing phonemes or a string of phonemes in the digital form and reproducing basic sound waveforms as will be described hereinafter. The third block 3 includes a solid state read only memory ROM 2 for storing in a digital fashion information (referred to as "compression instruction information") useful in carrying out various adjustment operations including the varying of pitch intervals, the varying of amplitudes, repetition of the pitch intervals and changing of the time axis. The fourth or reproduction block 4 forms consecutive digital synthesized waveforms according to an adjustment operation. The fifth block 5 is provided for temporary storage and the sixth block 6 is provided for transfer of the synthesized waveforms and reduction in distortion factor and quantizing noise through filtering effects. The seventh and last block 7 is a block arranged to convert the digital synthesized waveforms into its corresponding analog waveforms.

The CPU in the block 1 specifies a string of instructions for speech messages to be outputted. The sound output instructions from the CPU provide access to selected addresses of the solid state memory ROM 2 in the block 3 for fetching the desired instruction information therefrom. The compression instruction information enables the phonemes to be fetched sequentially or selectively from the ROM 1 and the circuit block 4 to execute the above mentioned adjustment operations on the basic sound waveforms consisting of the fetched phonemes.

The synthesizing method according to the present invention features the provision of the control memory ROM 2 independently of the memory ROM 1 storing the phonemes which form the basic sound waveforms. In other words, the control memory ROM 2 stores a variety of control information representative of pitch intervals, amplitudes, repetition numbers, it is desirable that the phonemes be stored in as small a number of bits as possible.

The following description will set forth the phonemes stored in the memory, information structure as to the respective phonemes and the various adjustment operations.

Figure 2:
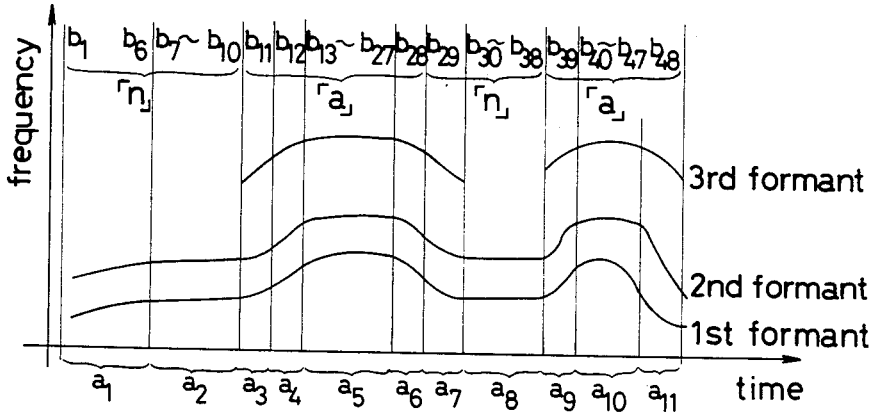
FIG. 2 is an illustrative waveform graph of the frequency of an analog electrical signal representing an original sound "nana ("seven" in English)" plotted as a function of time and a parameter of the formant frequency.

FIG. 2 is an illustrative waveform graph of the frequency of an analog electric signal representing an original sound "nana" (numeric "seven" in English) plotted as a function of time and a parameter of formant frequencies (first through third).

A general way to obtain a power spectrum of voices is Fourier conversion of the original sound information with the aid of a well known spectrum analyzer. Thus, the original sound information is represented by intensity at respective frequencies of the original sounds. There are certain formant frequencies with respective frames (pitches) of the resulting original sound information. As previously mentioned, the generation of appropriate formant frequencies of the phonemes is the most important requirement for intelligent sound synthesis.

The graph of FIG. 2 shows the first through third formant frequencies within each frame of the original sound "nana". The original sound comprises a total of 48 frames ($b_1$–$b_{48}$).

The frequency which approximates the respective frames $b_1$–$b_{48}$ representing the original sound can be defined by a string of 11 phoneme data $a_1$–$a_{11}$. The first formant frequency representing the connected data $a_1$ and $a_2$, i.e., the phoneme "n" is approximately 200–300 Hz, while the second formant frequency is approximately 400–500 Hz. The first, second and third formant frequencies representing the phoneme "a" are 600–700 Hz, 1200 Hz and 2600–2700 Hz. Similar phoneme data of $a_1$–$a_{11}$ can be replaced as below:

$$a_1\ a_2\ a_3\ a_4\ a_5\ a_6\ a_7\ a_8\ a_9\ a_{10}\ a_{11}$$

$$\downarrow$$

$$a_1\ a_2\ a_3\ a_4\ a_5\ a_4\ a_3\ a_2\ a_4\ a_5\ \ a_3$$

Accordingly, because of repetition in data, the original sound of voice "nana" can be comprised of five basic phoneme data $a_1$, $a_2$, $a_3$, $a_4$ and $a_5$.

The data representing the original sound within the respective frames $b_1$–$b_{48}$ can be written as follows:

| | Original sound frame | Phoneme data | Replaced phoneme data | Modified original sound data |
|---|---|---|---|---|
| [n] | $b_1 \sim b_6$ | $a_1$ | $a_1$ | $x_1 \sim x_6$ |
| | $b_7 \sim b_{10}$ | $a_2$ | $a_2$ | $x_7 \sim x_{10}$ |
| [a] | $b_{11}$ | $a_3$ | $a_3$ | $x_{11}$ |
| | $b_{12}$ | $a_4$ | $a_4$ | $x_{12}$ |
| | $b_{13} \sim b_{27}$ | $a_5$ | $a_5$ | $x_{13} \sim x_{27}$ |
| | $b_{28}$ | $a_6$ | $a_4$ | $x_{28}$ |
| [n] | $b_{29}$ | $a_7$ | $a_3$ | $x_{29}$ |
| | $b_{30} \sim b_{38}$ | $a_8$ | $a_2$ | $x_{30} \sim x_{38}$ |
| [a] | $b_{39}$ | $a_9$ | $a_4$ | $x_{39}$ |
| | $b_{40} \sim b_{47}$ | $a_{10}$ | $a_5$ | $x_{40} \sim x_{47}$ |
| | $b_{48}$ | $a_{11}$ | $a_3$ | $x_{48}$ |

In other words, the original sound "nana" is stored in the form of a string of the 5 phonemes $a_1$–$a_5$ within the memory ROM 1. The contents of the phoneme waveform information are of use when synthesizing compressed voices by merely storing selected portions of the waveform information. The modified original sound frames $x_1$–$x_{48}$ are established by repetition of the phoneme data and the appropriate adjustment operations. For instance, the modified original sound frames can be defined by varying the phoneme, the pitch interval, the amplitude and the time axis modifier factor, etc.

By way of example, the original sound frames $x_1$–$x_6$ can be written as follows:

$$x_1 \cong F(a_1, p_1, s_1, t_1)$$

$$x_6 \cong F(a_1, p_6, s_6, t_6)$$

Why the foregoing formula is an approximate equation is that the level and pitch are standardized. In the formula p is the pitch interval, s is the amplitude factor and t is the time axis modifier factor. Those varying factors are provided as the compression instruction information stored in rhe solid state memory ROM 2.

Figure 3:
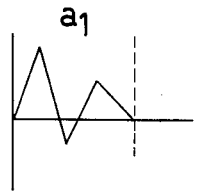
FIG. 3 is a waveform diagram of a basic phoneme "$a_1$"
Figure 4:
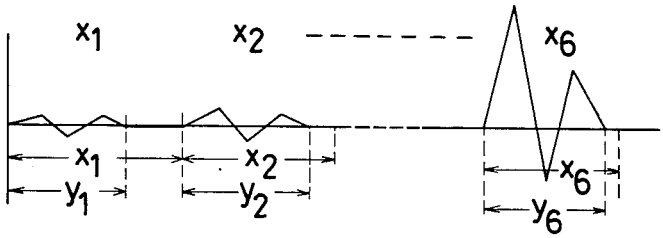
FIG. 4 is a waveform diagram of $x_1$–$x_6$ when variable factors are taken into consideration with respect to the basic phoneme.

FIG. 3 shows an illustrative example waveform of a basic phoneme "$a_1$", while FIG. 4 is an example of waveforms $x_1$–$x_6$ wherein the varying factors such as the pitch interval, the amplitude, the time axis modifier factor are taken into account with respect to the basic phoneme waveform $a_1$. That is, the phoneme waveform $a_1$ is represented as a function of time and can be modified by the amplitude factor $\alpha_n$ as long as $y_1$–$y_6$ and $a_1$ are kept in the following relationship. It is therefore possible to obtain a synthesized waveform which is a multiple of the phoneme waveform.

$$y_1 = \alpha_1 a_1$$
$$\vdots$$
$$y_6 = \alpha_1 a_1$$

wherein $\alpha_n$ is the amplitude factor stored within the memory ROM 1.

One of the significant features of the present invention lies in the fact that the compressed synthesized waveforms are obtainable through adjustment operations such as varying of the pitch interval, varying of the amplitude and the varying of the time axis modified factor.

Figure 5:
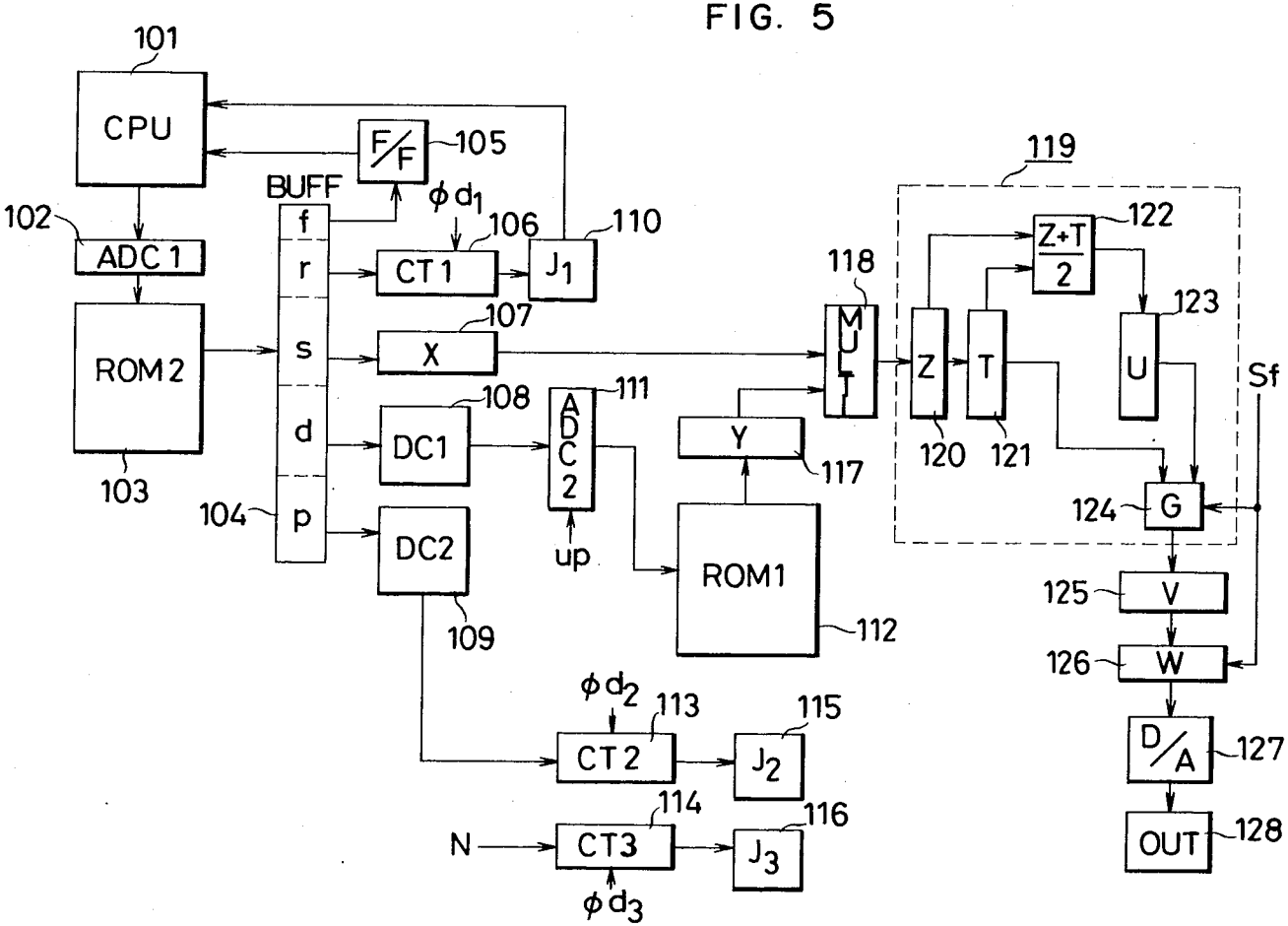
FIG. 5 is a more detailed block diagram of the speech synthesizer of FIG. 1.

FIG. 5 details in a schematic block diagram the speech synthesizer of the present invention as shown in FIG. 1, wherein CPU, ROM 1 and ROM 2 correspond to those shown in FIG. 1.

An address counter ADC 1 as denoted by 102 provides access to a desired address of the memory ROM 2 in response to the sound output instructions from the CPU 101. The ROM 2 containing the compression instruction information is labeled 103. A buffer register BUFF for temporary storage of the information derived from the ROM 2 is labeled 104. f stores data identifying the end of the string of the information and the end of accessing, whereas r stores the repetition time of the pitch intervals.

It is appreciated that sounds of musical instruments and human beings are generally the repetition of the same waveforms. For musical instruments sounds of the same height bear the same waveform and the frequency of sounds equals the time of the occurrence of a pitch per second. Though human sounds are a repetition of very similar waveforms, sounds vary in not only frequency (pitch frequency) but also waveform in the case of spoken words, and the repeated waveform can be regarded as the same waveform only for a very short length of time. The compression factors N is available by loading the memory ROM 2 with information representative of N.

BUFF 104 also stores amplitude information s. A desirable synthesized waveform of a fixed multiple relationship is provided by multiplying the basic phoneme waveforms as illustrated in FIGS. 3 and 4 by a specific amplitude factor. d is used as temporary information when fetching sequentially or selectively the phonemes from the memory ROM 1. The selected information is decoded into the leading address via a decoder $DC_1$ and loaded into another address counter ADC 2.

p is the information which specifies the pitch interval and is converted into an actual pitch length via a decoder DC 2 (109) and loaded into a counter CT2 labelled 113. An X register 107 stores the amplitude information s on which multiplication is executed in cooperation with the contents of a Y register labeled 117 shown as containing the phomenes shifted from the memory ROM 1 through the use of a multiplier MULT 1 (118).

A flip-flop F/F 105 detects the f information contained within the temporary storage register BUFF 104 and informs the CPU 101 of the result thereof. If f=1, then the flip flop F/F is set to inform the CPU that his information identifies the end of the addressing operation. A counter CT1 (106) counts the repetition time r and a decision circuit $J_1$ (110) decides if the contents of the counter CT1 are zero. Similarly, decision circuits J2 and J3, respectively labeled 115 and 116 decide if counters CT2 and CT3 (113 and 114) are zero. A counter CT3 labeled 114 is loaded with the number N of data establishing the voice waveforms. The output of the multiplier 118 is further applied to a circuit 119 in order to minimize quantizing noise through filter effects. This circuit 119 comprises an operator 122 for calculating intermediate values between buffer registers Z, T and U and registers Z and T and more particularly (z+T)/2 which is then loaded into the U register 123. It further comprises a G selection gate 124 for gating out alternately the contents of the U and T registers at the sampling frequency $S_f$. Details of this selection gate will be discussed later. The output of the G selection gate 124 via V and W registers 125 and 126 is converted into an analog waveform through the use of a digital-to-analog converter 127 and an output circuit 128 outputs an analog sound signal.

Figure 6:
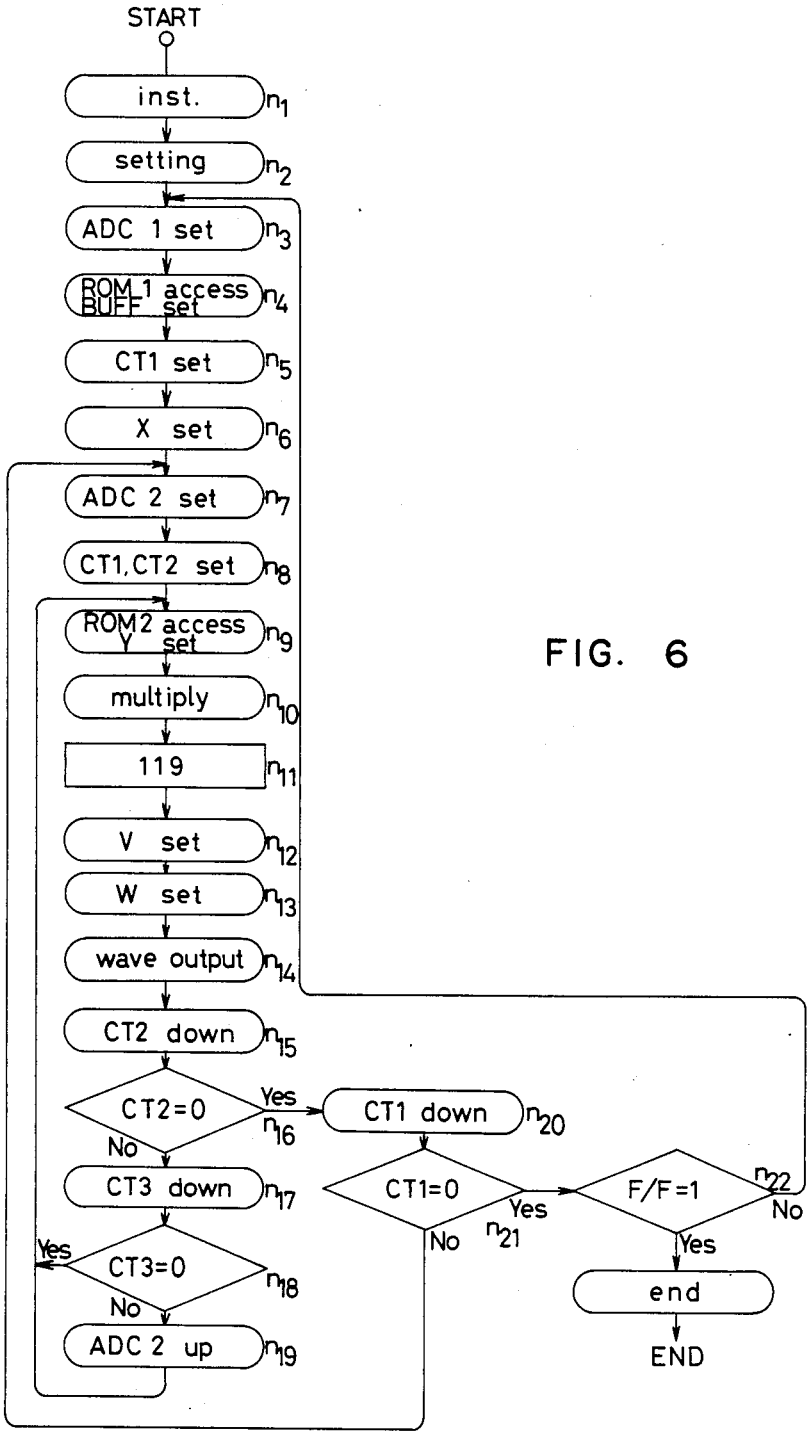
FIG. 6 is a flow chart for explanation of the operation of the device of FIG. 5.

The operation of this circuit will be more fully understood by reference to a flow chart of FIG. 6 wherein $n_i$ denotes a specific operating step.

Upon the development of the waveform output instruction from the CPU 101 (the step $n_1$) the respective registers and flip flops are loaded with their initial values and the initial address is loaded into the address counter 102 for selection of the initial information (the steps $n_2$ and $n_3$). This address provides access to the ROM 2 memory 103 and loads the temporary storage BUFF register 104 with the various compression instruction information (the step $n_4$). The information r representative of the repetition number is shifted from the BUFF register 104 into the counter $CT_1$ ($n_5$) and the amplitude information s is loaded into the X register 107 ($n_6$). The information d specifying the phonemes within the ROM 1 memory 112 is decoded into the leading address of the ROM 1 through the decoder 108 and loaded into the ADC 2 address counter 111 ($n_7$). The pitch information p is converted into an actual pitch length via the DC2 decoder 109 and loaded into the CT2 counter 113. The compression number N of the data which establishes the basic sound waveform is unloaded from the ROM 1 into the CT3 counter ($n_8$). The compression number N of the data is variable. The ADC 2 address counter 111 is therefore ready to have access to the ROM 1 memory 112 storing the phonemes, with the output thereof being loaded into the Y register 117 ($n_9$). The multiplier 118 multiplies the contents of the Y register by the amplitude information stored within the X register 107 and the results thereof are placed into the V register 125 through the quantizing noise reduction circuit 119 ($n_{12}$). The contents of the V register are transferred into the W register 126 in synchronism with the sampling frequency $S_f$($n_{13}$). The contents of the W register are converted into an analog waveform via the digital-to-analog converter 127 and outputted externally via the output circuit 128 ($n_{14}$).

After the completion of this step, the CT2 counter 113 and the CT3 counter 114 are decremented in synchronism with the sampling frequency $S_f$. Unless the CT2 and CT3 counters are zero (the contents of the two counters are monitored by the decision circuits J2 and J3 if they are zero), the ADC 2 address counter 111 is incremented ($n_{15}$ to $n_{19}$) to provide access to the ROM 1 memory 112 ($n_9$) and generate a waveform in the same manner as discussed above. A string of waveforms are provided through repetition of the above procedure (the steps).

On the other hand, if the CT2 counter 113 senses zero ($n_{16}$), then the CT1 counter 106 is decremented ($n_{20}$). When the contents of the CT1 counter are sensed as non-zero by the decision circuit J1 (110), the ADC 2 address counter 111 and the counters CT2 and CT3 are loaded as discussed above to provide waveforms ($n_7$–$n_{14}$). However, if the decision circuit J3 senses zero before the decision circuit J2 senses zero, then the ADC 2 address counter 111 is supplied with the increment instruction no longer. The ADC 2 address counter 111 continues to address the same data until the decision circuit J2 (115) senses zero in the CT2 counter 113. Accordingly, the W register 126 is loaded with the same value to provide an analog waveform via the digital-to-analog converter 127 and the output circuit 128. The above procedure continues until the J1 decision circuit 110 senses zero in the contents of the counter CT1. If $J_1=O(n_{21})$, the subsequent output condition is set to the BUFF register 104 unless the flip flop 105 is set ($n_{22}$). The contents of the flip flop 105 inform the CPU of the end of the addressing operation ($n_{23}$).

Some modifications are possible in the circuit arrangement of FIG. 5. Although the embodiment shown in FIG. 5 uses the decoders DC1 and DC2, the leading address and the address range may be loaded into the ROM 2 and the information d and p may be introduced into the AD2 address counter 111 and the CT2 counter 113 from the BUFF register 104 without passing over the decoders.

In this case the ROM 2 memory 103 should have a large data capacity. For instance, for male adults the pitch frequency is within a range of 60–200 Hz. If it is sampled at 10 kHz, the output has at most 167 samples and requires 8 bits for notation. Provided that possible values of the pitch frequency are 32 by quantizing techniques, It can be represented by 5 bits with a saving of 3 bits per compression instruction information.

Figure 7:
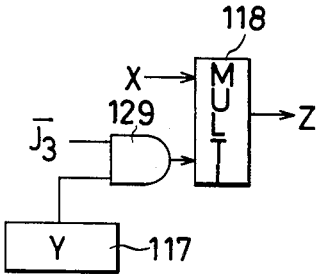
FIGS. 7 to 10 inclusive are diagrams showing modifications in the device of FIG. 5.

In the embodiment shown in FIG. 5, the end data is loaded into the Y register 117 after the development of the N outputs when CT2>CT3. The modified embodiment of FIG. 7 is adapted to send O to the multiplier 119 after J3 has been set. In other words, the basic sound waveforms consisting of the phonemes from the ROM 1 become fixed in pitch but variable in pitch frequency by addition of data of a given bias level, thus reducing the memory capacity and increasing the compression ratio.

Figure 8:
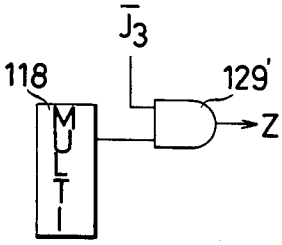
Figure 9:
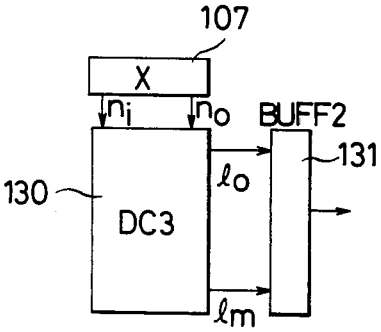
Figure 10:
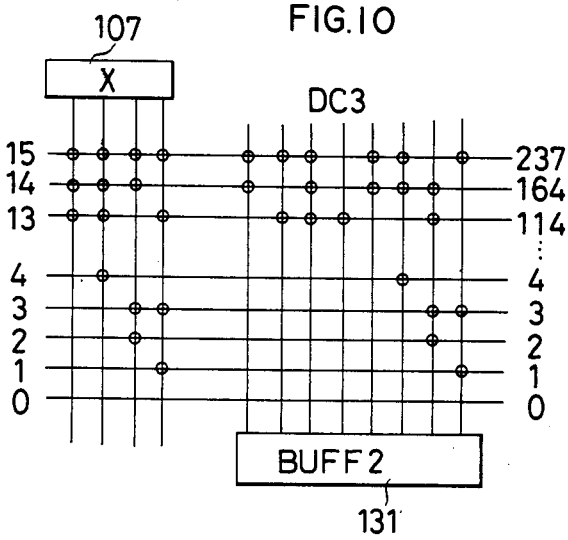

An input of a gate 129' to the multiplier 118 may comprise $\overline{J3}$ as viewed from FIG. 8. The amplitude information s may be controlled in either a linear relationship as FIG. 5 or a nonlinear relationship as in FIG. 9. In the latter case, the contents of the X register 107 are weighed through the DC 3 decoder 130 and loaded into the BUFF 2 register 131, then multiplied by the multiplier 118. For instance, if i=3 and m=7, then the results are shown in FIG. 10 in which $(1.44)^n$ is illustrated wherein n=1−15.

The quantizing noise reduction circuit 119 of FIG. 5 will operate as follows: Assume now that the number of data bits stored in the Y register 117 is 4 bits and the number of data bits in the X register 107 containing the amplitude information s is 3 bits. In this case the results calculated from the multiplier 118 should be represented by more than 4 bits. Possible data levels within the Y register 117 are $16(2^4)^4$ and possible multiples of the data in the X register are $8(2^3)$. Possible output levels from the multiplier 118 are thus $16\times8=128$, requiring 7 (27=128) bits. The results calculated from the multiplier 118 are longer than the number of bits of the Y register 117. This makes it possible to store the basic sound waveforms within the ROM 1 memory in the form of a minimum length of quantizing bits, which are then controlled by the amplitude information, thus reducing distortion and quantizing noise.

The quantizing noise reduction circuit is shown within a block 119 in FIG. 5 as denoted by a broken line, which includes Z, T and U buffer registers respectively labeled 120, 121 and 122. The circuit 122 calculates (z+T)/2 from the contents of the Z and T registers with its results enabling a gate 124 in synchronism with the sampling frequency so that the V register 125 is loaded with the contents of the U register 123 and the T register 121 alternately.

Figure 11:
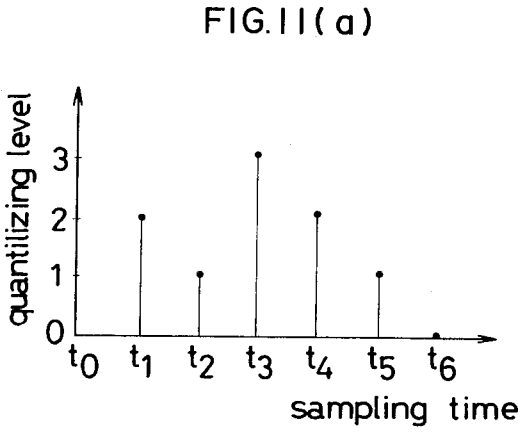
FIGS. 11*a*, 11*b*, 11*c* show a graph of quantizing levels as plotted as a function of sampling time.
Figure 11:
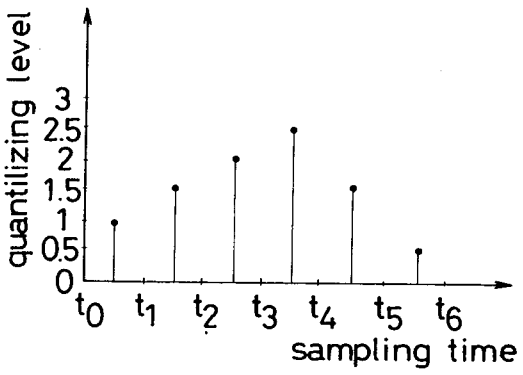
Figure 11:
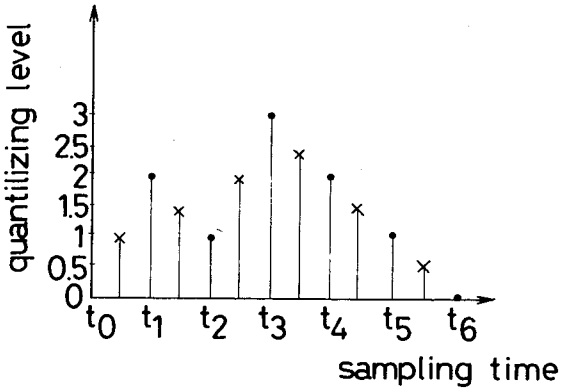

FIG. 11 is a graph representing the quantizing levels plotted as a function of sampling time. Provided that data as depicted in FIG. 11(*a*) are derived in sequence from the multiplier 118, the V register 125 provides sequential outputs as depicted in FIG. 11(*c*). Digital-to-analog conversion is achieved after sampling points are placed between the sampling times $t_o$, $t_1$, $t_2$ . . . . An average value of the quantizing level at $t_o$ and that at $t_1$ is interleaved between to and $t_1$. The U register 123 therefore provides the data as depicted in FIG. 11(*b*) to be alternately selected with the data as in FIG. 11(*a*) by the V register 125 of which the output is illustrated in FIG. 11(*c*). The resulting quantized data are converted into an analog waveform through the digital-to-analog converter 127, thus smoothing the waveform developing at the output circuit 128 and reducing quantizing noise.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A method for synthesizing speech waveforms comprising the steps of:

(a) storing digital speech information designating speech phonemes in a first addressable memory;

(b) storing in a second addressable memory digital compression command information in a normalized form, said compression command information being capable of modifying the phonemes at least with respect to pitch cycle and amplitude and reading said phonemes out of said first memory means either selectively or sequentially;

(c) reading out the compression command information in the normalized form from said second memory;

(d) decoding the normalized form of said compression command information into the actual digital form;

(e) modifying said phonemes using the actual digital form of said compression command information to form continuously digitalized synthetic speech waveforms;

(f) converting the digitalized synthetic speech waveforms into analog waveforms; and (g) quantizing said continuously digitalized synthetic waveform at predetermined spaced sampling times, computing the average value of the waveform between adjacent spaced sampling times, interleaving said average values into said waveform between said adjacent spaced sampling times to generate a composite quantized digital waveform and converting said composite quantized digital waveform into an analog waveform.

2. An apparatus for synthesizing speech waveforms comprising:

(a) first addressable memory means for storing digital speech information designating speech phonemes;

(b) second addressable memory means for storing digital compression command information in a normalized form, said compression command information being capable of modifying the phonemes at least with respect to pitch cycle and amplitude and reading said phonemes out of said first memory means either selectively or sequentially;

(c) means for reading out the compression command information in the normalized form from said second memory;

(d) means for decoding the normalized form of said compression command information into the actual digital form;

(e) means for modifying said phonemes using the actual digital form of said compression command information to form continuously digitalized synthetic speech waveforms;

(f) means for converting the digitalized synthetic speech waveforms into analog waveforms;

(g) means for quantizing said continuously digitalized synthetic waveform at predetermined spaced sampling times;

(h) means for computing the average value of the waveform between adjacent spaced sampling times;

(j) means for interleaving said average values into said waveform between said adjacent spaced sampling times to generate a composite quantized digital waveform; and (j) means for converting said composite quantized digital waveform into an analog waveform.

* * * * *